United States Patent [19]

Daswick

[11] 4,348,821

[45] Sep. 14, 1982

[54] SHOE SOLE STRUCTURE

[76] Inventor: Alexander C. Daswick, 700 Orange Grove, Apt. 210, South Pasadena, Calif. 91030

[21] Appl. No.: 155,589

[22] Filed: Jun. 2, 1980

[51] Int. Cl.[3] ..... A43B 13/12; A43B 13/18; A43B 5/06

[52] U.S. Cl. ..... 36/103; 36/32 R; 36/114; 36/129; 36/30 R

[58] Field of Search ..... 36/25 R, 28, 29, 30 R, 36/32 R, 83, 91, 103, 114, 129

[56] References Cited

U.S. PATENT DOCUMENTS

| | | | |
|---|---|---|---|
| 2,435,976 | 2/1948 | Monagin | 36/30 R |
| 3,835,556 | 9/1974 | Panaretus | 36/28 X |
| 4,030,213 | 6/1977 | Daswick | 36/30 R |
| 4,041,618 | 8/1977 | Famolare, Jr. | 36/25 R |
| 4,041,619 | 8/1977 | Sapper | 36/25 R |
| 4,155,180 | 5/1929 | Phillips | 36/129 |
| 4,241,523 | 12/1980 | Daswick | 36/30 R |
| 4,262,433 | 4/1981 | Hagg et al. | 36/25 R |

FOREIGN PATENT DOCUMENTS

| | | | |
|---|---|---|---|
| 189541 | 4/1957 | Austria | 36/25 R |

*Primary Examiner*—James Kee Chi

*Attorney, Agent, or Firm*—Gene W. Arant

[57] ABSTRACT

A shoe sole structure is provided with an upper surface adapted to receive and support the entire foot of the wearer, the sole structure being resilient throughout the full length of its under surface, having a toe portion forwardly of the metatarsal arch region which is easily bendable, but having a relatively stiff and rigid upper surface from the metatarsal region rearwardly to the heel. The sole structure has an elevated central pedestal under the instep region and a separate impact pad underneath the heel, the heel impact pad being very resilient while the central pedestal has limited resiliency. In a running action the heel impact pad absorbs an initial impact with the ground, the central pedestal then provides a rolling support for the entire foot, and finally the bending of the toe portion of the sole structure provides an effective and well-controlled take-off.

28 Claims, 10 Drawing Figures

SHOE SOLE STRUCTURE

RELATED APPLICATION

The invention disclosed in the present application is an improvement over that disclosed in my copending application Ser. No. 945,443 filed Sept. 25, 1978, now U.S. Pat. No. 4,241,523.

BACKGROUND OF THE INVENTION

Shoes, sandals, and the like have been devised and designed in many different ways and fashions and for a great many different reasons. Cost, convenience, and appearance are often dominant considerations.

The conventional full-length shoe sole with separate heel piece has been used almost universally and is widely accepted. In recent years a number of types of special shoes have been designed specifically for running or jogging. Modern manufacturing methods and the presently available types of materials have changed some of the hypotheses upon which earlier shoe designs were based.

The present invention is directed towards the development of a shoe sole structure that will be mechanically effective for walking, for jogging, or for running. To be mechanically effective a jogging or running shoe must provide proper absorption of impacts, effective and well-guided take-off, and must also provide adequate support and protection to the wearer's foot.

Thus the object and purpose of the present invention is to provide a novel shoe sole structure which is mechanically effective in absorbing impacts, in supporting and protecting the foot of the wearer, and in providing effective and well-guided take-off.

PRIOR ART

U.S. Pat. No. 4,030,213 (Daswick).

U.S. Pat. No. 4,047,310.

U.S. Pat. No. 4,177,582.

"The Complete Book of Running", by James F. Fixx, Random House, Inc., New York, 1977, at Pages 134–137.

Scientific American Magazine, December 1978, "Fast Running Tracks", Pages 148 et seq.

SUMMARY OF THE INVENTION

According to the present invention a shoe sole structure is arranged so as to efficiently perform the mechanical functions that are required of it, including the absorbing of impacts, supporting and protecting the foot of the wearer, and providing an effective and well-guided take-off action.

According to the invention the shoe sole structure is made relatively rigid on its upper surface from the heel region up to and including the metatarsal arch region. This part of the structure also has very little bending capability. As a result, the main part of the wearer's foot including heel, instep or inner arch region, and metatarsal arch region is firmly supported by the sole structure in fixed relation thereto. The sole structure extending forward of the metatarsal arch, however, is easily bendable and preferably also resilient.

Another principal feature of the invention is that the sole structure has a downwardly extending central pedestal in the inner arch or instep region. This central pedestal is longitudinally rounded on its under side to provide a rolling action. It also has substantial height and limited resiliency, thus ensuring that the main part of the foot is supported at a definite elevation above the ground. According to the invention the central pedestal cooperates with the rigid portion of the sole structure to support the entire weight of the runner's body during horizontal transitional movement.

Another feature of the invention is the provision of a resilient heel impact pad that is longitudinally rounded on its under surface and is separate from the central pedestal. The heel impact pad is effective for absorbing impacts with the earth, particularly when running, and particularly when the wearer of the shoe is running with a type of movement such that the heel strikes the ground first.

Another and further novel feature of the invention lies in the method of fabrication of the sole structure, such that only two cast or molded parts are required to fabricate the entire sole structure.

DRAWING SUMMARY

DETAILED DESCRIPTION

(FIGS. 1–10)

Figure 8:
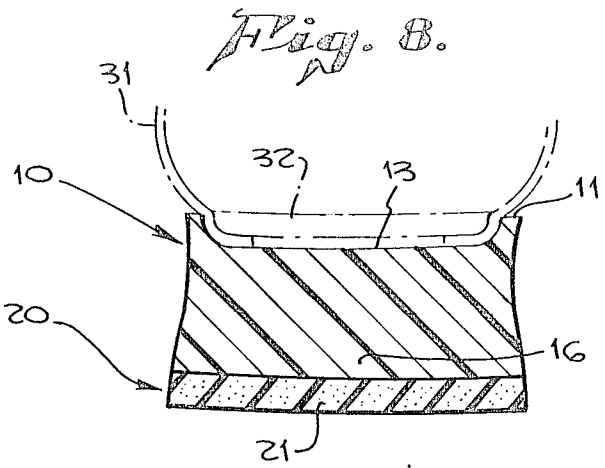
FIG. 8 is a transverse cross-sectional elevational view of the shoe sole structure taken on line 8—8 of FIG. 2.
Figure 9:
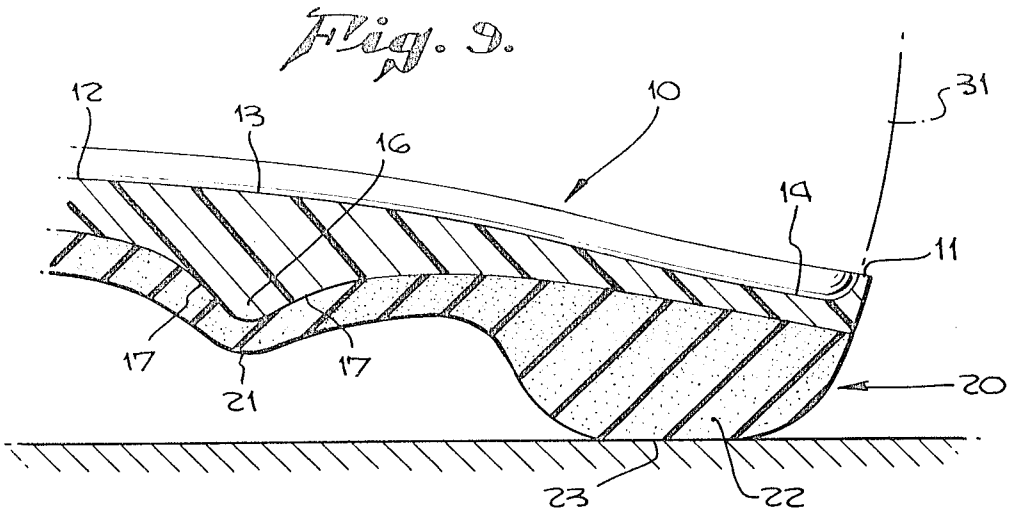
FIG. 9 is a fragmentary cross-sectional elevation view of the rearward end portion of the sole structure illustrating heel impact during running.
Figure 10:
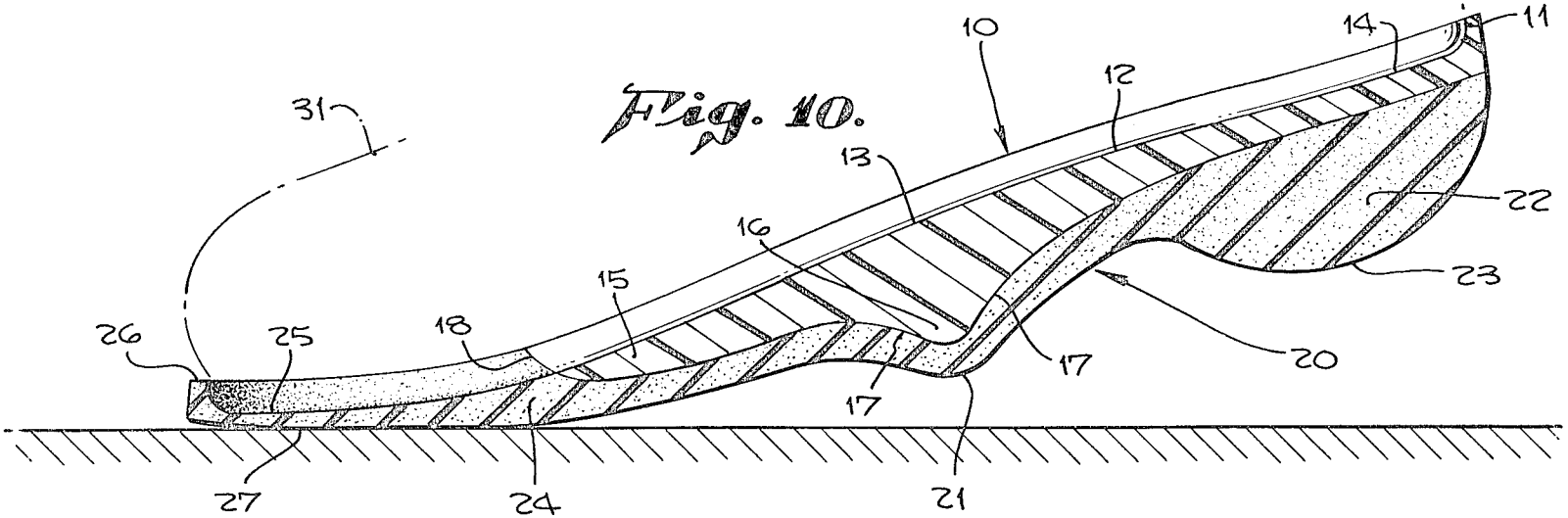
FIG. 10 is a longitudinal cross-sectional elevation view of the shoe structure illustrating the take-off action of the toe during running.

Reference is now made to the drawings illustrating the presently preferred embodiment of the invention. FIGS. 1–8 illustrate the sole structure itself. FIGS. 9 and 10 illustrate the dynamics involved in walking or running. FIGS. 3 and 8 illustrate the complete shoe of which the sole structure is a part.

The sole structure itself will first be described, and then the complete shoe and its mode of operation or use will be described subsequently.

THE SOLE STRUCTURE

Figure 1:
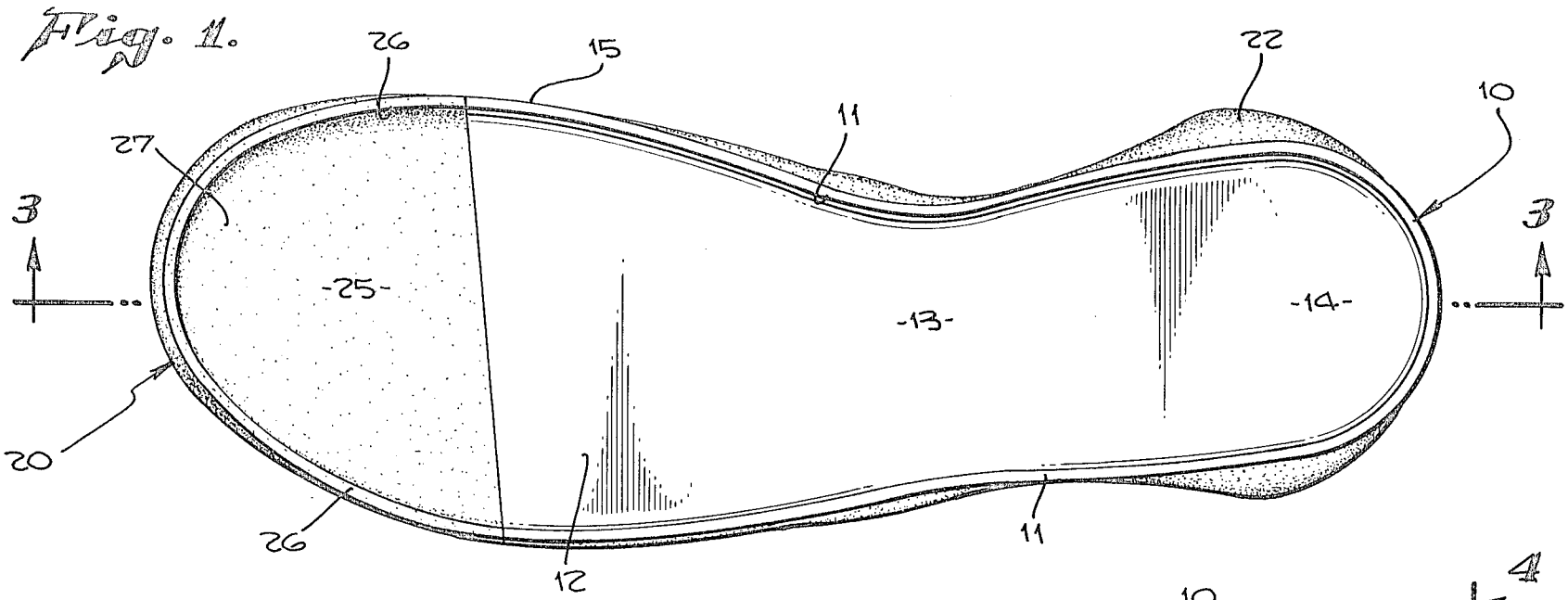
FIG. 1 is a top plan view of a novel shoe sole structure in accordance with my invention.
Figure 2:
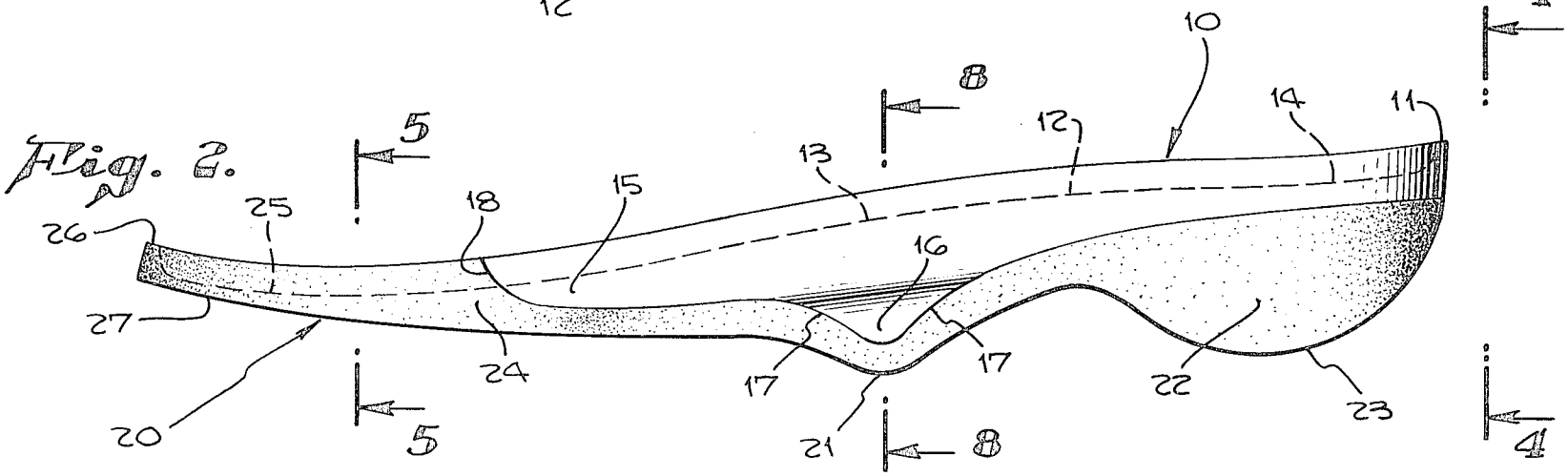
FIG. 2 is a longitudinal side elevation view of the shoe sole structure of FIG. 1.
Figure 3:
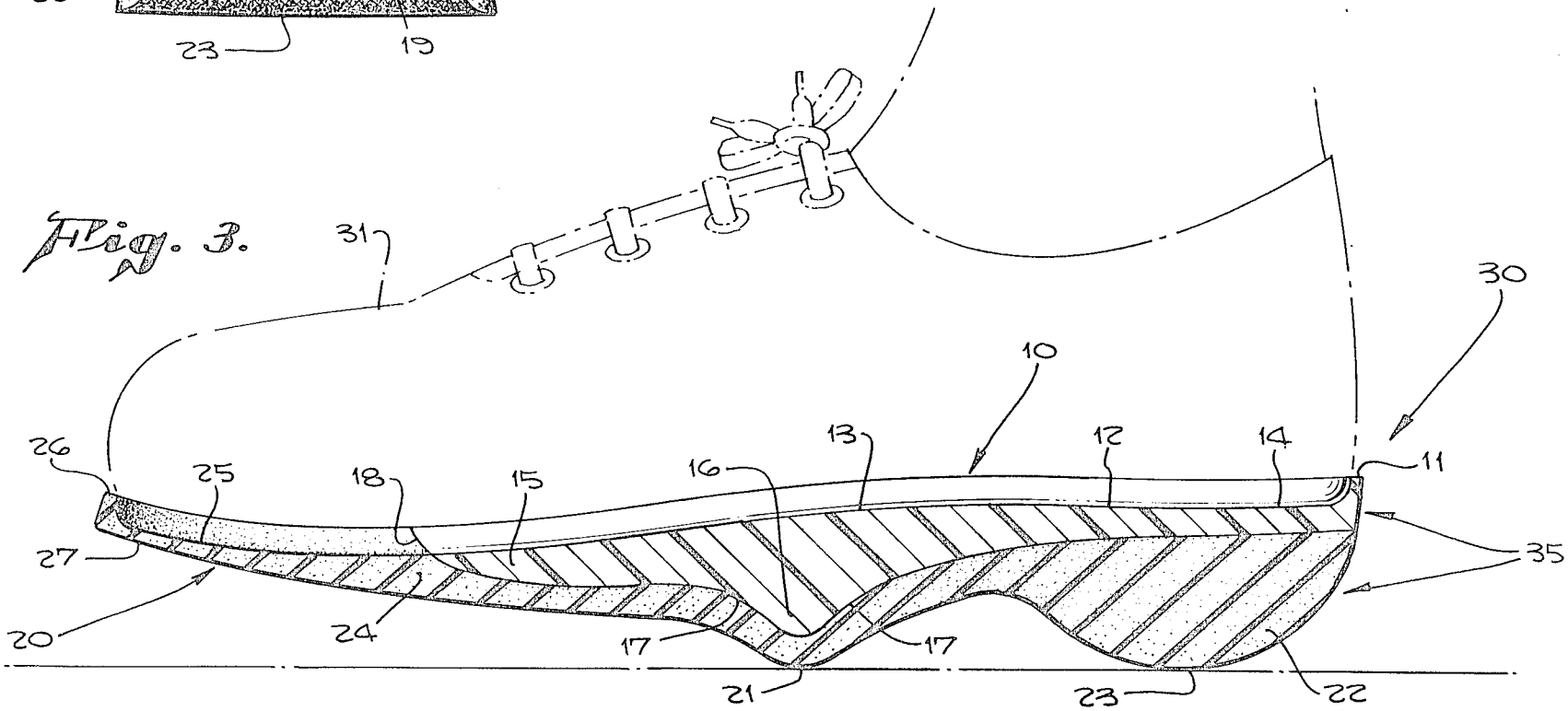
FIG. 3 is a longitudinal cross-sectional elevation view of the shoe sole structure taken on line 3—3 of FIG. 1.
Figure 6:
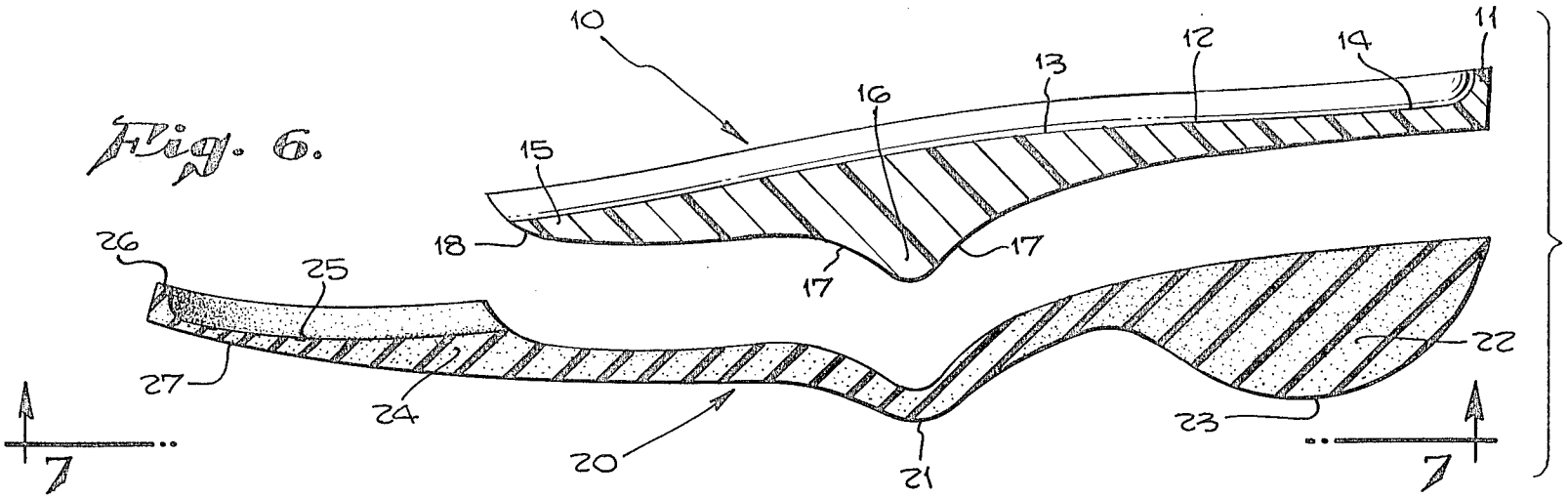
FIG. 6 is a longitudinal cross-sectional elevation view of the shoe structure but showing the rigid support member and resilient ground-engaging member in separated, spaced relationship.
Figure 7:
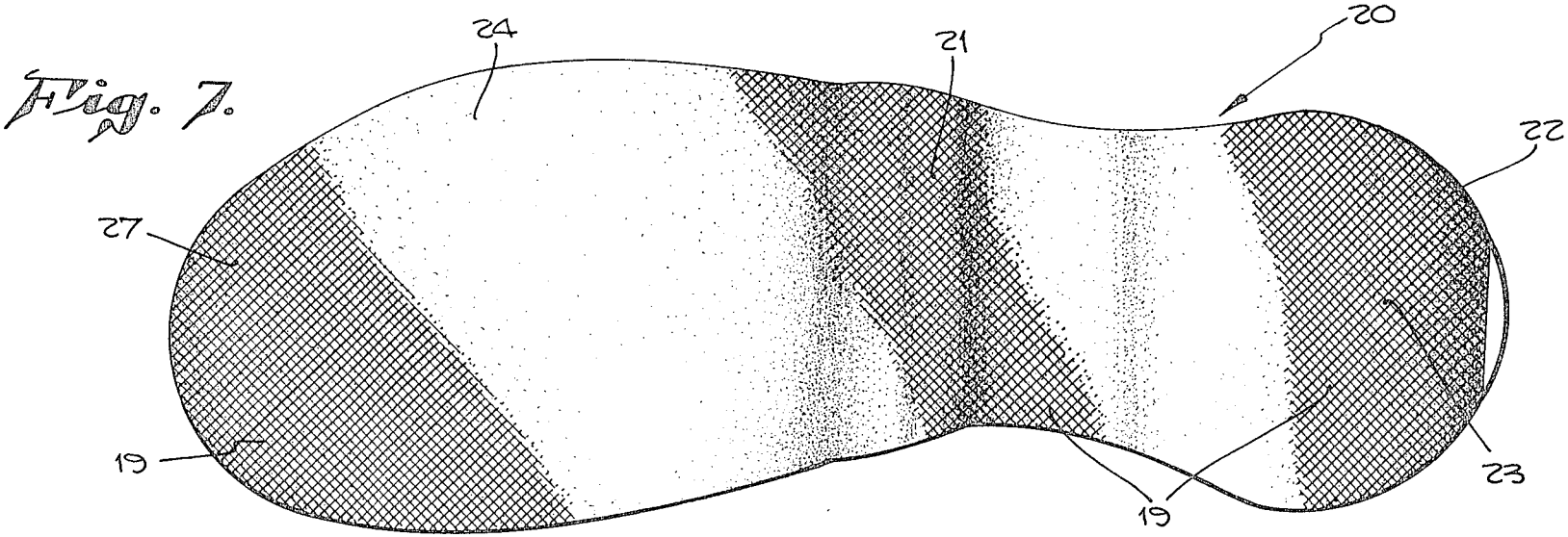
FIG. 7 is an underneath view of the ground-engaging member taken on line 7—7 of FIG. 6.

Referring to FIGS. 2 and 3, the sole structure includes a rigid upper support member 10 and a resilient lower or ground-engaging member 20. Each of these parts is separately molded or cast. The two parts are shown in FIG. 6 in a separated or exploded relationship.

The rigid support member 10 is made from a rather stiff plastic material which has extremely limited resilience and some, though limited, bending capability. The material used is quite dense and not only resists compression, but also has very little tendency to take a permanent set after it has been squeezed or compressed.

The resilient ground-engaging member 20, in contrast, is molded or cast from a highly resilient rubber material. It is of the order of about half the density of the upper support member. It can bend very easily. It can also be rather easily compressed to half or two-thirds of its normal thickness. It also has no observable tendency to take a permanent set, and springs back to its original shape when the squeezing or compression force is released.

The rigid upper support member 10 is fully illustrated in FIGS. 1, 2, 4, 5, and 8. It extends underneath the heel area, hence forward underneath the instep or inner arch area of the foot, and into about the middle of the ball of the foot, otherwise known as the metatarsal arch region. It has an upstanding flange 11 which extends the full length of both of its lateral edges and also extends in a curved configuration around the extremity of the heel. Except for the flange 11, the upper surface 12 is substantially flat; however, it does have somewhat of a convex upward curvature at 13 in the inner arch region. At its rearward end the heel portion 14 has a thickness of about 3/16 inch; the height of the flange 11 throughout is also about 3/16 inch. At its forward end 15 near the metatarsal arch region the support member 10 has a thickness of about one-quarter inch or less.

A short distance forward of its longitudinal center the rigid support member 10 is thickened in a downward direction to form a central pedestal 16 about 15/16 inch high and which is longitudinally curved on its under surface 17. At its forward end the support member 10 is arcuately curved on its under surface 18, the radius of curvature of that curved surface being about a half inch to an inch.

The resilient ground-engaging member 20 extends the full breadth and length of the shoe, but underlies the rigid support member 10 as far as the upper support member extends. Throughout its length and breadth the resilient member 20 has a minimum thickness of about three-eighths inch. It has a longitudinally curved portion 21 which underlies the central pedestal 16 of the rigid support member. Both the upper and lower surfaces of the curved portion 21 are longitudinally curved. Thus in the assembled relation as shown in FIG. 2 the pedestal parts 16, 21 form a central pedestal which is essentially stiff and unbending except for the bottom layer 20 of resilient material. This pedestal therefore provides a rolling support for the wearer of the shoe.

Resilient member 20 at its rearward end is thickened in a downward direction to provide a heel impact pad 22. The maximum vertical thickness of the impact pad is about one inch. Its under surface 23 is longitudinally rounded with a radius of curvature of about one to two inches.

At a location just forward of the forward end of rigid support member 10 the resilient member 20 is thickened in the upward direction at 24. Its forward end forms a toe pad 27 which underlies the toe region and whose upper flat surface 25 forms a forward extension of the upper surface 12, 13 of rigid support member 10. A peripheral flange 26 rises up from the sides and forward end of the toe pad 27 of the resilient member. Although made of different material, the flanges 11, 26 are otherwise substantially of the same size and configuration and together form a continuous flange which encircles the upper surface 25, 12, 13 of the shoe sole structure.

At its forward extremity, beneath the forward limit of the upper surface 25, resilient member 20 has a thickness of about one-quarter inch. This thickness together with the flange 25 give it a total vertical thickness at its extreme forward end of nearly a half inch.

The thickness of the sole structure measured at central pedestal 16, 21 is substantially equal to the thickness measured at heel impact pad 10, 22, but with the heel impact pad being slightly thicker. The under surface of the central pedestal 21 extends about one-quarter inch below a plane defined by the under surfaces of heel pad 22 and the toe region. See FIGS. 2 and 3.

The rigid plastic member 10 and the resilient rubber member 20 are separately molded or cast. A corrugated bottom surface 19, FIG. 7, may be cast integrally with the resilient member 20 but is preferably provided instead by a thin rubber sheet member that is glued onto the bottom surface of the resilient member 20. The rigid member 10 and resilient member 20 are glued together by means of a suitable adhesive material placed between their mating surfaces, or are secured together by other suitable means.

THE SHOE STRUCTURE

Figure 5:
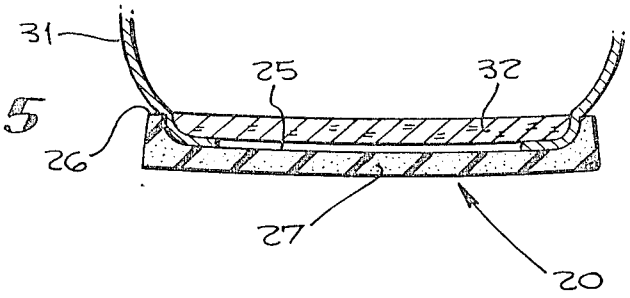
FIG. 5 is a transverse cross-sectional elevation view taken on line 5—5 of FIG. 2, and also showing the shoe upper and insole.
Figure 4:
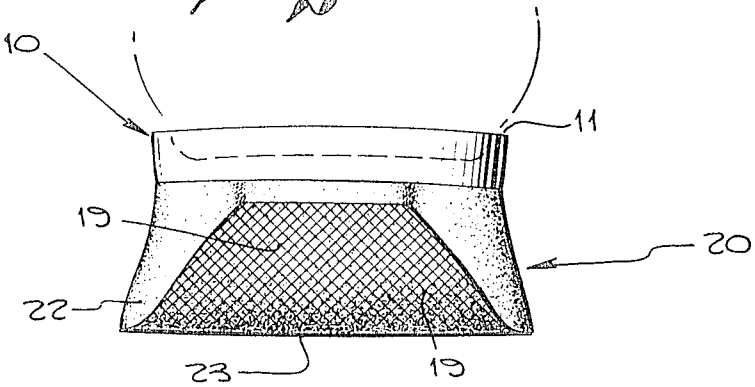
FIG. 4 is a rear end elevation view of the shoe sole structure taken on line 4—4 of FIG. 2.

As shown in FIGS. 3, 5 and 8 the complete shoe 30 includes a conventional shoe upper 31 whose lower extremity is received within the peripheral flange 11, 26. The bottom surface of the shoe upper is then glued to the upper surfaces 25, 12, 13 of the sole structure by means of a suitable adhesive material.

Also included in the complete shoe structure is an insole 32 that is of conventional construction. It is likewise glued in place.

The composite sole structure shown in FIG. 2 including both the rigid support member 10 and the resilient member 20 is collectively identified by reference numeral 35. Thus the complete shoe 30 includes a sole structure 35, a shoe upper 31, and an insole 32.

MODE OF OPERATION

It has previously been pointed out that the shoe sole structure of the present invention is intended for use in a walking or running action where the heel hits the ground first. The operation is therefore described in terms of the three major phases, which are the heel impact, the transitional movement, and the toe thrust or lift-off.

HEEL IMPACT

FIG. 9 at least partially illustrates the heel impact action. The resilient heel impact pad 22 compresses in a vertical direction to absorb the impact. There is at the same time a forward rolling of the shoe and foot, which is greatly facilitated by the curved under surface of the rearward and forward ends of the heel impact pad.

The specific angle of the initial heel impact depends, of course, upon the particular running or walking stance of the person wearing the shoe. The magnitude of compression of the heel impact pad also depends upon the particular walking or running action as well as the weight of the wearer of the shoe.

As the heel impact progresses, the foot of the wearer of the shoe is firmly held within the shoe upper and is firmly supported upon the rigid upper support member 10. The forward rolling action on the heel impact pad is, of course, propelled by the forward motion of the person wearing the shoe. Both the downward force and the forward rolling motion are imparted to the upper support member 10 which, because of its substantial rigidity, imparts both the downward force and the rolling motion in a very smooth and even manner to the resilient ground-engaging member 20. The support member 10 ensures that the load is imparted over as wide an area as possible of the resilient member 20. The longitudinally curved under surface of the heel impact pad 22 permits both the impact absorption and the rolling movement to be accomplished in a smooth and evenly controlled fashion, irrespective of the relative rates of the two different types of movement.

It is also significant that heel impact pad 22 is wider at the bottom than it is at the top. See FIG. 4. This construction of the heel impact pad not only protects the wearer of the shoe from an inadvertent turning or twisting movement, but also causes the load to be distributed over a larger area of the running surface.

THE TRANSITIONAL MOVEMENT

As the forward rolling movement of the shoe and foot continue, a point is reached where the resilient portion 21 of the central pedestal contacts the ground. At this time the heel impact pad 22 is still heavily compressed, hence the toe pad 27 does not engage the ground at the same time.

As earlier described, the sole structure is of such configuration that, when the resilient member 20 is not under compression, the bottom surface of the central pedestal extends below the common plane of the bottom surfaces of the heel and toe. See FIG. 3. When the entire weight of the wearer of the shoe is placed on the heel impact pad or rear pedestal there is a significant amount of compression of that pad, which further exaggerates the downward protrusion of the central pedestal. The forward rolling movement of the shoe necessarily results in ground contact by the resilient portion 21 of the central pedestal before the load on the rear pedestal is relieved.

As the transition proceeds the weight of the runner becomes evenly distributed between the rear and central pedestals, and then is shifted primarily to the central pedestal. Since the relatively rigid portion 16 of the central pedestal is very much thicker than its resilient portion 21, the central pedestal tends to accept the load far more readily than does the rear pedestal, where the reverse arrangement is true.

In this connection it is important to note that there is a smooth and continuous transfer of load from the rear pedestal to the central pedestal. This smooth transition is due in part to the construction of the pedestals and in part to the substantially rigid structure of upper support member 10, which accepts the entire weight of the runner in a unitary fashion. The smoothness of the transition is the same whether the forward rolling movement of the runner's foot occurs relatively rapidly or relatively slowly.

The entire weight of the runner then becomes transferred to the central pedestal 16, 21. A rolling movement of the foot also takes place but without any bending of the foot itself because of the firm support by the rigid member 10. A smooth rolling action is made possible by the longitudinally curved nature of both the forward and rearward ends of the rigid portion 16 of the central pedestal, as well as its accompanying resilient portion 21.

Both the height of the central pedestal and its location are of rather critical significance. The longitudinal position of the central pedestal must be in proper relationship to the center of gravity of the runner's body during the transitional period. The movements of the runnder's body and center of gravity thereof are described and discussed, for example, in the Scientific American article that has been listed above.

The location of the central pedestal 16, 21 is, in general, beneath the instep of inner arch region of the shoe. The present drawings show the preferred design of the rigid support member 10 and resilient support member 20 for a shoe that is suitable for either walking, jogging, or running. In this design the central pedestal is located about 43% of the length of the resilient member 20 from its rearward end and 57% of its length from its forward end. Relative to the rigid support member 10 it is located about 63% of its length from its rearward end and 37% of its length from its forward end.

In a shoe specifically designed for hard running the central pedestal 16, 21 may be moved slightly forward and its height or thickness may also be reduced. At the same time the thickness of the heel impact pad is also reduced.

In a shoe designed specifically for walking the central pedestal may be moved slightly rearward and also made somewhat higher or thicker. At the same time the height of the heel impact pad is increased somewhat.

During the forward rolling movement on the central pedestal there is also some compression of its resilient portion 21. This provides an adequate cushioning of the foot since the main part of the impact has previously been absorbed by the heel impact pad 22.

TOE THRUST OR LIFT-OFF

As the forward rolling movement of the wearer's foot and the shoe continue some of the load becomes transferred to the toe pad 27. See FIG. 10. The runner uses his toes to raise his foot above the ground and in doing so to also guide the take-off action.

The central pedestal 16, 21 also plays a significant part in the take-off. Specifically, it ensures that the shoe, and hence the foot of the runner, is at a desired minimum elevation above the ground. The forward rolling action which occurs with the central pedestal as the pivot point causes an initial upward bending of the toe pad 27 as well as the toes of the runner's foot, and thus positions the toes for take-off more rapidly and without requiring an active energy output from the runner. Furthermore, most of the thrust necessary for lift-off can be developed directly from the central pedestal in cooperation with support member 10, while the longitudinal arch which carries all the weight of the body is in turn supported by the rigid member 10. The rounded under surface 18 of the forward end of support member 10 also assists in developing the needed thrust, so that far less weight is supported by the toes and metatarsal arch than required in conventional shoes.

During the take-off action the toe pad 27 bends significantly relative to the remainder of resilient member 20, and relative to the rigid support member 10. The toe pad 27 also bends within its own confines, and at the same time compresses vertically, in the manner and to the extent that is required for the take-off action.

RESTORING STARTING POSITION

After take-off has occurred the toe pad 27 and the runner's toes are bent upward relative to the remainder of the foot. The foot, however, is bent downward relative to the ankle and lower leg. As the runner's foot passes through the air he restores the foot and shoe to their starting position prior to another heel impact as shown in FIG. 9.

ALTERNATE FORMS

While support member 10 and resilient member 20 are shown as two parts which are made separately and then secured together, it may instead be preferred to first form a rigid or stiffening member or frame, and then mold the resilient rubber around it.

The invention has been described in considerable detail in order to comply with the patent laws by providing a full public disclosure of at least one of its forms. However, such detailed description is not intended in any way to limit the broad features or principles of the inventin, or the scope of patent monopoly to be granted.

What is claimed is:

1. In a running shoe, a sole structure adapted to support and protect the foot of the wearer while permitting movement at the metatarsal arch thereof, comprising:

means providing an elongated generally flat base extending from heel to toe, the portion of said base extending rearwardly of the metatarsal arch being substantially rigid, the portion of said base forward of the metatarsal arch being adapted to selectively bend upwardly relative to said rigid rear portion thereof;

resilient means carried underneath said base for cushioning the movements of the wearer's foot; and pedestal means under the instep region of said base;

said pedestal means cooperating with said rigid rear portion of said base for supporting the entire weight of the wearer's body during horizontal transitional movement, and having a longitudinally curved under surface for imparting a rolling motion to the wearer's foot without any bending thereof.

2. A shoe sole structure for a running shoe, having an upper surface adapted to support the entire foot of the wearer and an under surface adapted to engage the ground, characterized by a rear pedestal extending downward beneath the heel of the shoe and a central pedestal extending downward beneath the instep, said central pedestal being longitudinally rounded on its under side to provide a roller-like portion of said sole structure under surface, said rear pedestal being very resilient while said central pedestal has far less resiliency, and said sole structure being easily bendable at and forward of the metatarsal arch region but being resistant to bending rearwardly thereof.

3. A shoe sole structure as in claim 2 which consists only of a resilient ground-engaging member extending the full length thereof, and a relatively rigid support member positioned above the central and rearward portions of said ground-engaging member and secured thereto.

4. A shoe sole structure as in claim 2 wherein the vertical thickness of the sole structure through said rear pedestal is greater than the vertical thickness through the central pedestal.

5. A shoe sole structure as in claim 3 wherein the vertical thickness of the sole structure through said rear pedestal is greater than the vertical thickness through the central pedestal.

6. A shoe sole structure as in claim 2 wherein said central pedestal extends below a plane defined by the under surfaces of said rear pedestal and the toe portion of said sole structure.

7. A sole structure for a shoe comprising, in combination:

an elongated relatively rigid support member adapted to extend beneath the heel, inner arch, and metatarsal arch region of the wearer's foot and to firmly support the same thereon;

a resilient ground-engaging member extending underneath said support member in generally parallel relationship thereto for receiving and supporting the same, said ground-engaging member also extending forwardly of said support member to receive and support the toes of the wearer's foot;

said two members cooperatively providing a continuous and smoothly contoured upper surface for supporting the wearer's foot thereon;

said resilient member having a downwardly extending heel impact pad formed on its rearward end; and said two members cooperatively forming a downwardly extending central pedestal underneath the inner arch portion of the wearer's foot, said central pedestal having limited resiliency and being longitudinally rounded on its under surface.

8. In a shoe having an upper which receives the full length of the wearer's foot, a shoe sole structure for receiving and supporting the upper, comprising:

a relatively rigid member extending underneath the heel and hence forward to and underneath the metatarsal arch;

a resilient ground-engaging member extending forwardly of said rigid member for supporting the toes, said two members cooperatively providing a continuous, generally flat upper supporting surface;

said rigid member being downwardly thickened near the longitudinal center of said sole structure to provide a transverse, longitudinally rounded central pedestal;

said resilient member also extending rearwardly underneath said rigid member in substantially parallel relation therewith, being longitudinally rounded beneath said central pedestal, and being downwardly thickened near its rearward end to provide a heel impact pad, said impact pad being also longitudinally smoothly rounded on its under side; and the thickness of said sole structure measured at said pedestal being substantially equal to the thickness measured at said heel impact pad.

9. In a shoe having an upper which receives the full length of the wearer's foot, a shoe sole structure for receiving and supporting the upper, comprising:

a relatively rigid member extending underneath the heel and hence forward to and underneath the metatarsal arch;

a resilient ground-engaging member extending forwardly of said rigid member for supporting the toes, said two members cooperatively providing a continuous, generally flat upper supporting surface;

said rigid member being downwardly thickened near the longitudinal center of said sole structure to provide a transverse, longitudinally rounded central pedestal;

said resilient member also extending rearwardly underneath said rigid member in substantially parallel relation therewith, being longitudinally rounded beneath said central pedestal, and being downwardly thickened near its rearward end to provide a heel impact pad, said impact pad being also longitudinally smoothly rounded on its under side; and the under surface of said resilient member at said central pedestal extending below a plane defined by the under surfaces of said heel impact pad and the toe portion of said resilient member.

10. A shoe sole structure comprising:

a relatively rigid member having a generally flat upper surface which extends beneath the heel and thence forward to and underneath the metatarsal arch, said member being of similar thickness at its two ends but being downwardly thickened at a location slightly forward of its longitudinal center to form a transversely extending, longitudinally rounded central pedestal;

a resilient ground-engaging member disposed beneath said rigid member and extending the full length thereof in engagement therewith for supporting the same, said resilient member also extending forwardly of said rigid member underneath the toes;

said forwardly extending portion of said resilient member providing an extension of said upper surface of said rigid member; and the heel portion of said resilient member being downwardly thickened to provide a heel impact pad;

the under surface of said resilient member being longitudinally rounded both at said central pedestal and at said heel impact pad.

11. A shoe sole structure comprising, in combination:

a resilient ground-engaging member adapted to extend the full length and width of a shoe;

said member having a downwardly depending heel portion having a vertical thickness of at least about one inch, the under surface of said heel portion being curved in a longitudinal direction to conform approximately to the arc of a circle having a radius of curvature of about one to two inches;

said ground-engaging member also having a transverse protrusion extending downwardly slightly rearwardly of its longitudinal center to form a pedestal, the under surface of said pedestal being extending below a plane defined by the under surface of said heel portion and the under surface of the metatarsal arch portion of said ground-engaging member;

means restricting the resilient upward deformation of said pedestal; and stiffening means cooperating with the upper surface of said ground-engaging member for restricting its longitudinal bending rearwardly of the metatarsal arch region.

12. A shoe sole structure as in claim 11 which includes a relatively rigid support member extending above the heel, instep, and metatarsal arch regions of said ground-engaging member and firmly secured thereto, said rigid support member and said ground-engaging member cooperatively providing a flat upper surface for supporting the entire length of a wearer's foot.

13. A shoe comprising, in combination:

a shoe upper;

an inner sole disposed within the lower extremity of said shoe upper for receiving and supporting a wearer's foot thereon;

a resilient ground-engaging member disposed beneath said shoe upper and extending the full length and breadth thereof, the forward end portion of said ground-engaging member being rounded in the horizontal plane to form a toe portion and having an upstanding flange around its outer periphery for receiving the shoe upper in supporting relation therewithin;

a rigid support member interposed between the shoe upper and the rearward portion of said ground-engaging memeber, said rigid support member extending laterally the full breadth of said shoe upper and extending longitudinally underneath the heel, instep, and metatarsal arch regions thereof in supporting relationship therewith;

the rearward end of said rigid support member being rounded in the horizontal plane to form a heel portion, and said rigid support member also having an upstanding flange extending the full length of its lateral edges as well as around the periphery of said heel portion for supportingly receiving said shoe upper therewithin; and said rigid support member and the forward portion of said ground-engaging member cooperatively providing a continuous and smoothly contoured upper surface for supporting said shoe upper.

14. A shoe as in claim 14 wherein said rigid support member is downwardly thickened near its longitudinal center to provide a transverse pedestal whose under surface is longitudinally rounded, the under surface of the associated portion of said resilient member being longitudinally rounded.

15. A shoe as in claim 14 wherein said resilient member also has a rear pedestal forming a heel impact pad.

16. A sole structure for a shoe comprising, in combination:

an elongated relatively rigid support member adapted to extend beneath the heel, inner arch, and metatarsal arch regions of the wearer's foot and to firmly support the same;

a resilient ground-engaging member extending underneath said support member in generally parallel relationship thereto for receiving and supporting said support member, said ground-engaging member also extending forwardly of said support member to support the toes of the wearer's foot;

said two members being secured together and cooperatively providing a continuous and smoothly contoured upper surface;

said resilient member having a downwardly extending heel impact pad formed near its rearward end; and said two members cooperatively forming a downwardly extending central pedestal underneath the inner arch portion of the wearer's foot, said central pedestal having limited resiliency and being longitudinally rounded on its under surface.

17. A sole structure as in claim 16 wherein the under surface of said heel impact pad is also longitudinally rounded.

18. A sole structure as in claim 16 wherein at the location of said central pedestal said rigid member is thicker than said resilient member, while at the location of said heel impact pad said resilient member is thicker than said rigid member.

19. A sole structure as in claim 16 whose thickness at said central pedestal is substantially equal to its thickness at said heel impact pad.

20. A sole structure as in claim 16 wherein said central pedestal extends below a plane defined by the under surfaces of said heel impact pad and the toe portion of said sole structure.

21. A sole structure as in claim 16 wherein said rigid member is downwardly thickened near the longitudinal center of said sole structure to provide a transversely extending central protrusion which is longitudinally rounded on its under surface, said resilient member being longitudinally curved to conform to said central protrusion, thereby forming said central pedestal.

22. A sole structure as in claim 16 wherein said central pedestal is located slightly forward of the longitudinal center of said rigid member.

23. A sole structure as in claim 16 wherein an upstanding flange is formed about the outer periphery of the upper surface thereof for receiving a shoe upper in supporting relation therewith.

24. A sole structure as in claim 16 wherein the under surface of the forward end of said rigid member is convexly curved in a longitudinal direction.

25. A sole structure as in claim 16 wherein said heel impact pad is wider at the bottom than at the top.

26. A sole structure as in claim 16 wherein the density of said resilient member is of the order of half the density of said rigid member.

27. A shoe sole structure comprising, in combination:

a resilient ground-engaging member adapted to extend the full length and width of a shoe;

said member having a downwardly depending heel portion having a vertical thickness of at least about one inch, the under surface of said heel portion being curved in a longitudinal direction to conform approximately to the arc of a circle;

said ground-engaging member also being convexly downwardly curved slightly rearwardly of its longitudinal center to form a central pedestal, the under surface of said central pedestal extending below a plane defined by the under surfaces of said heel portion and of the metatarsal arch portion of said ground-engaging member;

stiffening means cooperating with the upper surface of said ground-engaging member for restricting its longitudinal bending rearwardly of the metatarsal arch region; and means cooperating with said stiffening means for restricting the resilient upward deformation of said pedestal.

28. A shoe sole structure as in claim 27 which includes a relatively rigid support member disposed above said resilient member and extending from the heel portion to the metatarsal arch portion thereof, said two members being secured together; said rigid member providing said stiffening means and said restricting means.

* * * * *